US009803838B1

(12) United States Patent
Wronski et al.

(10) Patent No.: US 9,803,838 B1
(45) Date of Patent: Oct. 31, 2017

(54) SUPPORT BRACKETS FOR LAMP SOCKETS

(71) Applicants: Grzegorz Wronski, Peachtree City, GA (US); Jared Michael Davis, Newnan, GA (US)

(72) Inventors: Grzegorz Wronski, Peachtree City, GA (US); Jared Michael Davis, Newnan, GA (US)

(73) Assignee: Cooper Technologies Company, Houston, TX (US)

( * ) Notice: Subject to any disclaimer, the term of this patent is extended or adjusted under 35 U.S.C. 154(b) by 44 days.

(21) Appl. No.: 14/918,011

(22) Filed: Oct. 20, 2015

(51) Int. Cl.
*F21V 21/00* (2006.01)
*F21S 8/02* (2006.01)

(52) U.S. Cl.
CPC ..... *F21V 21/00* (2013.01); *F21S 8/02* (2013.01)

(58) Field of Classification Search
CPC .... F21S 8/02; F21S 8/022; F21S 8/026; F21S 8/028; F21V 21/04; F21V 21/00; F21V 19/0035; F21V 19/00; F21V 19/006
See application file for complete search history.

(56) References Cited

U.S. PATENT DOCUMENTS

| | | | | |
|---|---|---|---|---|
| 3,518,420 | A * | 6/1970 | Kripp | F21S 8/02 248/343 |
| 5,730,522 | A * | 3/1998 | Wyke | F21V 19/006 248/200 |
| 6,364,511 | B1 * | 4/2002 | Cohen | F21S 8/02 362/148 |
| 6,588,922 | B1 * | 7/2003 | DeCicco | F21V 21/04 362/148 |
| 9,341,349 | B1 * | 5/2016 | Moore | F21V 19/002 |
| 2013/0215623 | A1 * | 8/2013 | Goodman | F21V 21/00 362/341 |

* cited by examiner

*Primary Examiner* — Robert May
(74) *Attorney, Agent, or Firm* — King & Spalding LLP

(57) ABSTRACT

A bracket for a luminaire is described. The bracket can include a first portion having at least one first lamp socket connection system coupling feature disposed within a first body of the first portion, where the at least one first lamp socket connection system coupling feature is non-planar with the first body. The bracket can also include a second portion coupled to a proximal end of the body of the first portion, where the second portion includes at least one first housing coupling feature disposed within a second body of the second portion. The at least one first lamp socket connection system coupling feature can be configured to couple to at least one first bracket coupling feature of a socket of the luminaire. The at least one first housing coupling feature can be configured to couple to at least one second bracket coupling feature of a housing of the luminaire.

20 Claims, 8 Drawing Sheets

SUPPORT BRACKETS FOR LAMP SOCKETS

TECHNICAL FIELD

Embodiments described herein relate generally to luminaires, and more particularly to systems, methods, and devices for support brackets for lamp sockets of luminaires.

BACKGROUND

Recessed light fixtures are used in many residential, commercial, and industrial applications. Generally, the space in which to install a recessed light fixture is limited, and so the time to install a recessed light fixture can be increased when parts of the light fixture (e.g., the luminaire, the luminaire housing) are cumbersome to install.

SUMMARY

In general, in one aspect, the disclosure relates to a bracket for a luminaire. The bracket can include a first portion that includes at least one first lamp socket connection system coupling feature disposed within a first body of the first portion, where the at least one first lamp socket connection system coupling feature is non-planar with the first body. The bracket can also include a second portion coupled to a proximal end of the body of the first portion, where the second portion includes at least one first housing coupling feature disposed within a second body of the second portion. The at least one first lamp socket connection system coupling feature can be configured to couple to at least one first bracket coupling feature of a socket of the luminaire. The at least one first housing coupling feature can be configured to couple to at least one second bracket coupling feature of a housing of the luminaire.

In another aspect, the disclosure relates to a bracket for a luminaire. The bracket can include a first portion having at least one first lamp socket connection system coupling feature and at least one spring clip coupling feature disposed within a first body of the first portion, where the at least one first lamp socket connection system coupling feature and at least one spring clip coupling feature are physically separated from each other by the first body. The bracket can also include a second portion coupled to a proximal end of the body of the first portion, where the second portion comprises at least one first housing coupling feature disposed within a second body of the second portion. The at least one first lamp socket connection system coupling feature can be configured to couple to a lamp socket connection system of the luminaire. The at least one first housing coupling feature can be configured to couple to at least one second bracket coupling feature of a housing of the luminaire.

In yet another aspect, the disclosure can generally relate to a luminaire. The luminaire can include a housing having a housing body with at least one housing wall having an inner perimeter that forms a cavity, where the at least one housing wall includes at least one first bracket coupling feature. The luminaire can also include a socket assembly disposed within the housing, where the socket assembly can include a socket and a socket holder having a main portion and at least one second bracket coupling feature positioned adjacent to the main portion, where the socket is coupled to the main portion of the socket holder. The luminaire can further include a bracket disposed within the cavity and coupled to the at least one housing wall and the socket assembly. The bracket can include a first portion having at least one lamp socket connection system coupling feature disposed within a first body of the first portion, where the at least one lamp socket connection system coupling feature is coupled to the at least one second bracket coupling feature, where the at least one first lamp socket connection system coupling feature is non-planar with the first body. The bracket can also include a second portion coupled to a proximal end of the body of the first portion, where the second portion comprises at least one first housing coupling feature disposed within a second body of the second portion, where the at least one first housing coupling feature is coupled to the at least one first bracket coupling feature.

These and other aspects, objects, features, and embodiments will be apparent from the following description and the appended claims.

BRIEF DESCRIPTION OF THE DRAWINGS

The drawings illustrate only example embodiments of support brackets for lamp sockets of luminaires and are therefore not to be considered limiting of its scope, as support brackets for lamp sockets of luminaires may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
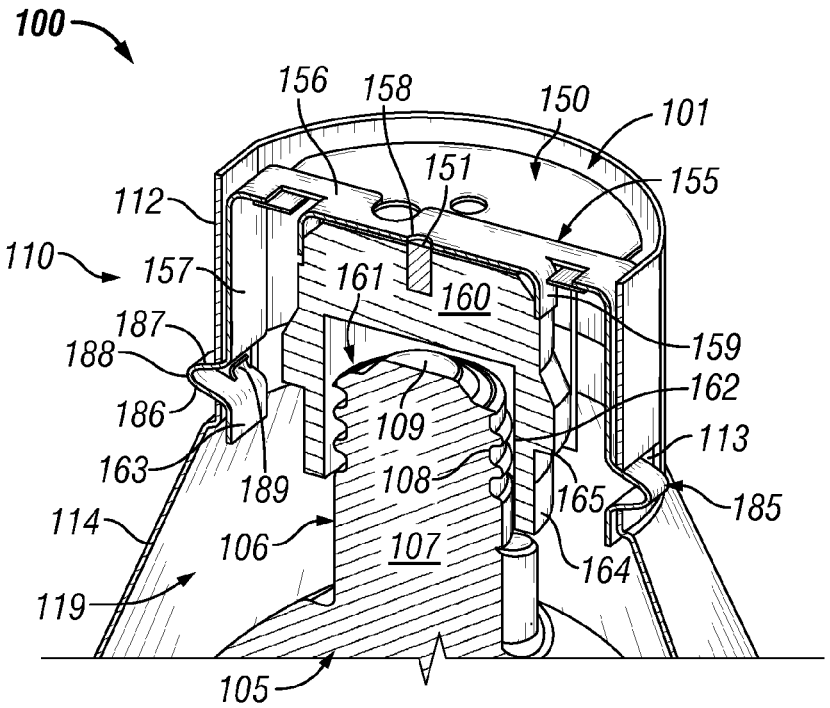
FIG. 1 (Prior Art)
FIG. 1 shows a cross-sectional side perspective view of a lamp socket connection system for a luminaire currently known in the art.

The example embodiments discussed herein are directed to systems, apparatuses, and methods of support brackets for lamp sockets. While the figures shown and described herein are directed to luminaires, example support brackets can also be used in other applications aside from luminaires, including but not limited to motor control centers, relay cabinets, gardening, and enclosures. Thus, the examples of support brackets (also referred to herein more simply as brackets) described herein are not limited to luminaires.

With respect to luminaires, while the example embodiments described herein are directed to recessed luminaires, example embodiments (or portions thereof) can also be used for non-recessed luminaires. Example luminaires can be used with one or more of a number of different types of lighting systems, including but not limited to light-emitting diode (LED) lighting systems, fluorescent lighting systems, organic LED lighting systems, incandescent lighting systems, and halogen lighting systems. Therefore, example embodiments described herein should not be considered limited to any particular type of luminaire or lighting system.

Any example support brackets (or portions (e.g., features) thereof) described herein can be made from a single piece (as from a mold). When an example support bracket (or portion thereof) is made from a single piece, the single piece can be cut out, bent, stamped, and/or otherwise shaped to create certain features, elements, or other portions of a component. For example, as discussed below, at least a portion of the support bracket can be made from a single sheet where various portions are cut out, bent, shaped, and otherwise manipulated to form an example support bracket.

Alternatively, an example support bracket (or portions thereof) can be made from multiple pieces that are mechanically coupled to each other. In such a case, the multiple pieces can be mechanically coupled to each other using one or more of a number of coupling methods, including but not limited to epoxy, welding, fastening devices, compression fittings, mating threads, and slotted fittings. One or more pieces that are mechanically coupled to each other can be coupled to each other in one or more of a number of ways, including but not limited to fixedly, hingedly, removeably, slidably, and threadably.

Components and/or features described herein can include elements that are described as coupling, fastening, securing, aligning, or other similar terms. Such terms are merely meant to distinguish various elements and/or features within a component or device and are not meant to limit the capability or function of that particular element and/or feature. For example, a feature described as a "coupling feature" can align, abut against, receive, be disposed within, and/or perform other functions aside from physically attaching (e.g., fasten, secure). In addition, each component and/or feature described herein can be made of one or more of a number of suitable materials, including but not limited to metal, rubber, and plastic.

A coupling feature (including a complementary coupling feature) as described herein can allow one or more components and/or portions of an example support bracket to become mechanically coupled, directly or indirectly, to a portion (e.g., a housing, a finishing section, a lamp socket) of a luminaire and/or to another portion of the support bracket. A coupling feature described herein can include, but is not limited to, a portion of a hinge, an aperture (as shown), a slot, a spring clip, a tab, a detent, a recess, a clamp, and a mating thread. An example support bracket can be coupled to a frame, a housing, and/or another component of a luminaire by the direct use of one or more coupling features. In addition, or in the alternative, an example support bracket can be coupled to a housing, a finishing section, a lamp socket, and/or another component of a luminaire using one or more independent devices that interact with one or more coupling features disposed on the example support bracket, housing, finishing section, lamp socket, and/or other component of a luminaire. Examples of such devices can include, but are not limited to, a pin, a hinge, a fastening device (e.g., a bolt, a screw, a rivet), and a spring. One coupling feature described herein can be the same as, or different than, one or more other coupling features described herein.

As described herein, a user can be any person that interacts with an example support bracket. Examples of a user may include, but are not limited to, an engineer, an electrician, a maintenance technician, a mechanic, an operator, a consultant, a contractor, a homeowner, and a manufacturer's representative.

The components of example support brackets described herein can be physically placed in outdoor environments. In addition, or in the alternative, example support brackets can be subject to extreme heat, extreme cold, moisture, humidity, high winds, dust, and other conditions that can cause wear on the support brackets, or portions thereof. In certain example embodiments, the portions of support brackets, as well as any coupling (e.g., mechanical, electrical) between such portions, are made of materials that are designed to maintain a long-term useful life and to perform when required without mechanical failure.

In one or more example embodiments, when the support brackets described herein are part of a luminaire, one or more components of the luminaire is subject to meeting certain standards and/or requirements. For example, the American Society of Testing and Materials (ASTM) creates, maintains, and publishes standards that apply to luminaires. For example, the ASTM publishes ASTM E283-04, which is a standard test method for determining rate of air leakage through exterior windows, curtain walls, and doors under specified pressure differences across the specimen. In other words, a luminaire is able to meet various standards that apply to the luminaire when example support brackets are used therein.

Examples of other authorities setting standards and/or regulations that can apply to example luminaires can include, but are not limited to, the National Electric Code (NEC), the Canadian Electric Code (CEC), the International Electrotechnical Commission (IEC), the International Energy Conservation Code (IECC), and Underwriter's Laboratories (UL). As used herein, an air-tight seal describes a seal between two or more coupling features of an example luminaire that allows the luminaire to meet ASTM E283-04 and/or any equivalent thereof. In other words, the term "air-tight seal" used herein is not taken literally, but rather is defined in context of ASTM E283-04 and/or any equivalent thereof.

Any component described in one or more figures herein can apply to any subsequent figures having the same label. In other words, the description for any component of a subsequent (or other) figure can be considered substantially the same as the corresponding component described with respect to a previous (or other) figure. The numbering scheme for the components in the figures herein parallel the numbering scheme for the components of previously described figures in that each component is a three or four digit number having the identical last two digits.

Example embodiments of support brackets will be described more fully hereinafter with reference to the accompanying drawings, in which example embodiments of support brackets are shown. Support brackets may, however, be embodied in many different forms and should not be construed as limited to the example embodiments set forth herein. Rather, these example embodiments are provided so that this disclosure will be thorough and complete, and will fully convey the scope of support brackets to those of ordinary skill in the art. Like, but not necessarily the same, elements (also sometimes called components) in the various figures are denoted by like reference numerals for consistency.

Terms such as "first," "second," "top," "bottom," "side," "upward," "downward," "distal", "left," and "right" are used merely to distinguish one component (or part of a component or state of a component) from another. Such terms are not meant to denote a preference or a particular orientation. Also, the names given to various components described herein are descriptive of example embodiments and are not meant to be limiting in any way. Those skilled in the art will appreciate that a feature and/or component shown and/or described in one embodiment (e.g., in a figure) herein can be used in another embodiment (e.g., in any other figure) herein, even if not expressly shown and/or described in such other embodiment.

FIG. 1 shows a cross-sectional side perspective view of a lamp socket connection system 101 for a reflector assembly 100 currently known in the art. Referring to FIG. 1, the reflector assembly 100 includes a reflector 110 (a type of finishing section), which includes a reflector body 114 and a receptacle 112 disposed at and coupled to a top end of the reflector body 114. The lamp socket connection system 101 fits inside the receptacle 112 and includes a spring clip 155 disposed over and coupled to a socket assembly 150. The socket assembly 150 includes a socket receiver body 160 that forms a cavity 161 (also called a socket or a female receptacle). The inner surfaces of the walls 164 that form the cavity 161 can have one or more coupling features (e.g., mating threads) for mechanically and electrically coupling to a male receptacle 106 of a light source 105.

For example, if the outer perimeter of the socket body 107 has mating threads 108 disposed thereon, then the inner surfaces of the walls 164 have a screw shell 162 (sometimes called mating threads) disposed thereon that are configured to couple to the mating threads 108 of the light source 105. As another example, if the top surface of the socket body 107 is an electrical contact 109, then the inner surface of the socket body 160 includes an electrical contact that complements the electrical contact 109. The light source 105, when coupled to the socket assembly 150, is disposed within a cavity 119 formed by the reflector body 114.

The light source 105 can use any type of lighting technology. Examples of such lighting technologies can include, but are not limited to, light emitting diode (LED), halogen, incandescent, sodium vapor, and mercury vapor. As shown in FIG. 1, the socket assembly 150 can be configured to receive a particular type of male receptacle 106 of the light source 105 to allow for electrical and mechanical coupling between the light source 105 and the socket assembly 150. Examples of a type of socket (e.g., male receptacle 106, female receptacle 161) can include, but are not limited to, an Edison screw base of any diameter (e.g., E26, E12, E 14, E39), a bayonet style base, a bi-post base, a bi-pin connector base, a wedge base, G10/GU10, G9/GU9, AR111/PAR36, T3, MR-11, and MR-16. The male receptacle 106 can have any configuration, including but not limited to IEC Type A through and IEC Type N.

The socket assembly 150 can have one or more coupling features 151 (in this case, an aperture) disposed in the top surface of the socket receiver body 160 to couple, directly or indirectly, to one or more complementary coupling features 158 (in this case, an aperture) disposed in the main body 156 of the spring clip 155. In addition, the top surface of the socket receiver body 160 can have one or more other coupling features 159 (in this case, tabs) that couple, directly or indirectly, to an outer side surface of the socket receiver body 160 (in this case, a recess).

On either side of the main body 156 of the spring clip 155 is a side body 157 that includes a receptacle coupling feature 185 that couples, directly or indirectly, to a complementary coupling feature 113 disposed in the receptacle 112. In this case, each receptacle coupling feature 185 is a clip, and each coupling feature 113 is an aperture into which a portion of the receptacle coupling feature 185 is disposed. The coupling feature 113 of the receptacle 112 can have one or more of a number of features. For example, the coupling feature 113 can include a tab that defines the aperture formed by the coupling feature 113. Each receptacle coupling feature 185 has various features, such as a top protrusion 187, a bottom protrusion 186, a tab 189, and an apex 188 where the top protrusion 187 and the bottom protrusion 186 meet.

A bottom extension 163 can extend from the bottom protrusion 186 of the receptacle coupling feature 185 and can be substantially planar with the side body 157. The tab 189 can extend from the top protrusion 187 and/or the bottom protrusion 186 in any of a number of directions (e.g., substantially parallel with the side body 157, as shown in FIG. 1). In some cases, not all features of the receptacle coupling feature 185 are used to couple the spring clip 155 to a portion of the luminaire (e.g., the receptacle 112). For example, as shown in FIG. 1, the tabs 189 of the receptacle coupling feature 185 are not used to couple the spring clip 155 to the receptacle 112. Instead, the top protrusion 187, the bottom protrusion 186, and the apex 188 of the receptacle coupling feature 185 are used to couple the spring clip 155 to the receptacle 112 in FIG. 1. Those of ordinary skill in the art will appreciate that the spring clip 155 can have any of a number of characteristics (e.g., shape, size, coupling features). Example brackets, discussed below, can be used with any spring clip (or equivalent thereof) have any such characteristics.

Because of the spring-like nature of the spring clip 155, each side body 157 (and, thus, each receptacle coupling feature 185) can move relative to the main body 156. To move a side body 157 inward, an inward force is applied to the side body 157. When that inward force is removed, the side body 157 returns to its natural position relative to the main body 156. When the spring clip 155 is coupled to the socket assembly 150, one or more features (e.g., protrusion 165) of the socket assembly 150 can limit the inward travel of a side body 157 of the spring clip 155. Further, as described below with respect to FIGS. 3A-3C, the protrusion 165 can also be a coupling feature 165 with respect to example brackets.

When the spring clip 155 is positioned relative to the receptacle 112 as shown in FIG. 1, the receptacle coupling features 185 couple to the complementary coupling feature 113 disposed in the receptacle 112 when the side body 157 returns to its natural position relative to the main body 156. To decouple the spring clip 155 from the receptacle 112, an inward force is applied to each side body 157 until the receptacle coupling features 185 are no longer disposed within the complementary coupling feature 113 disposed in the receptacle 112, and the lamp socket connection system 101 is moved within the receptacle 112.

Figure 2:
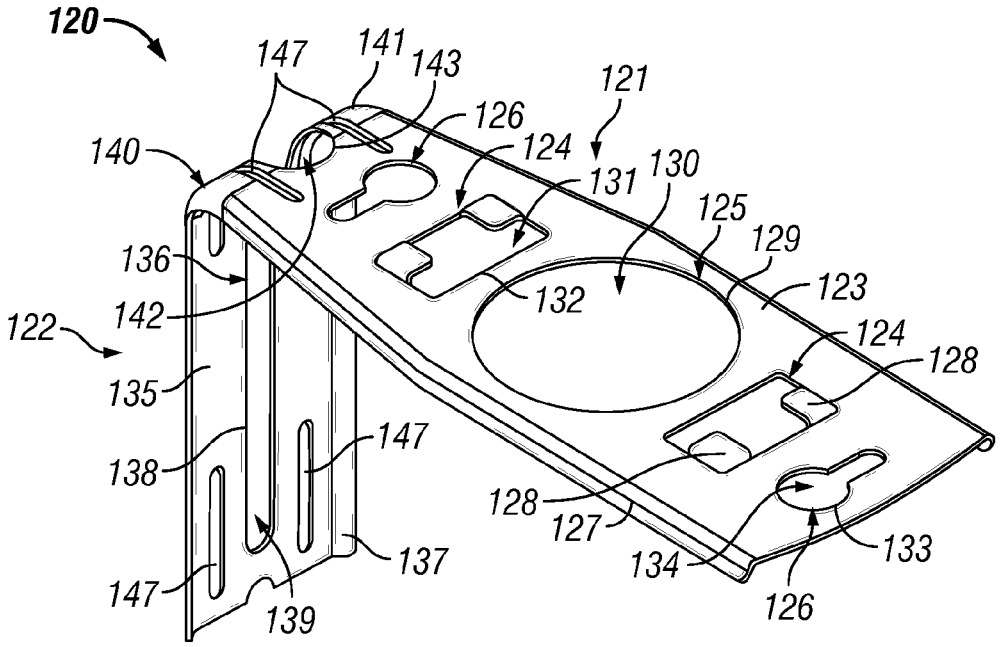
FIG. 2 show a top side perspective view of a bracket in accordance with certain example embodiments.

FIG. 2 show a top side perspective view of a bracket 120 in accordance with certain example embodiments. Referring to FIGS. 1 and 2, the bracket 120 includes one or more portions. For example, the bracket 120 shown in FIG. 2 has portion 121 and portion 122. When there are multiple portions of the bracket 120, those portions can be oriented in any of a number of ways with respect to each other. For example, as shown in FIG. 2, portion 121 of the socket 120 is substantially perpendicular to portion 122, where portion 121 and portion 122 are joined (e.g., coupled) to each other by optional portion 140, which serves as a transition piece and provides a smooth, curved edge where portion 121 and portion 122 are joined. Alternatively, any of a number of other angles (e.g., 75°, 120°) can be formed between portion 121 and portion 122.

Further, in this case, the body 123 of portion 121 and the body 135 of portion 122 are long and flat. As shown in FIG. 2, the profile of the body 123 of portion 121 aligns with the profile of the body 135 of portion 122. Alternatively, the profile of the body 123 of portion 121 can be oriented in any of a number of other ways (e.g., perpendicular) relative to the profile of the body 135 of portion 122. In addition, as shown in FIG. 2, one end of portion 122 is coupled to one end of portion 121. Alternatively, any part (e.g., middle, opposite end, side) of portion 121 can be coupled to any part (e.g., middle, opposite end, side) of portion 122.

In certain example embodiments, the orientation of portion 121 relative to portion 122 can be based on one or more of a number of factors. Such factors can include, but are not limited to, the characteristics (e.g., size, shape) of the finishing section (e.g., reflector body 114) of the luminaire or portion thereof (e.g., reflector assembly 100), the location of coupling features in the finishing section, the characteristics (e.g., size, shape, weight) and of the lamp socket connection system (e.g., lamp socket connection system 101), the characteristics (e.g., size, shape, orientation) of the coupling features (e.g., coupling features 185) of the lamp socket connection system, the characteristics (e.g., size, shape, weight) and of the finishing section, and the characteristics (e.g., size, shape, orientation) of the coupling features of the finishing section of the luminaire.

Each portion of the bracket 120 can include one or more coupling features for coupling the bracket 120 to one or more other components (e.g., finishing section, housing, lamp socket connection system) of the luminaire or portions (e.g., reflector assembly 100) thereof. For example, the portion 121 of the bracket 120 shown in FIG. 2 can include one or more socket receiver coupling features 125, one or more spring clip coupling features 124, and one or more finishing section coupling features 126. The socket receiver coupling features 125 and the spring clip coupling features 124 can generally be referred to as lamp socket connection system coupling features.

In certain example embodiments, the characteristics (e.g., size, shape, orientation) of the socket receiver coupling features 125 are designed to complement one or more coupling features of a socket receiver (e.g., socket assembly 150). In this case, there is one socket receiver coupling feature 125 that is an aperture 130 formed by an outer perimeter 129 and that traverses the thickness of the body 123 of portion 121. The shape and size of the aperture 130 can be substantially the same as, or slightly larger than, the shape and size of a portion (e.g., walls 164 at the distal end) of a socket receiver (e.g., socket assembly 150) that is disposed within the aperture 130 when the socket receiver is coupled to the socket receiver coupling feature 125. In this case, the aperture 130, when viewed from above, is circular in shape.

In certain example embodiments, the characteristics (e.g., size, shape, orientation) of the spring clip coupling features 124 are designed to complement one or more coupling features (e.g., coupling features 185) of a spring clip (e.g., spring clip 155). In this case, there are two spring clip coupling features 124 shown in FIG. 2, where each spring clip coupling feature 124 is an aperture 131 that traverses the thickness of the body 123 of portion 121. In addition, each spring clip coupling feature 124 is defined by an outer perimeter 132 as well as two tabs 128 that protrude above (are non-planar with respect to) the surface of the body 123 of portion 121. In such a case, the tabs 128 can be portions of the body 123 that are pressed outward relative to the rest of the body 123. In certain example embodiments, the tabs 128 are planar (do not protrude or recess) with respect to the body 123 of portion 121.

The tabs 128 are examples of features of the spring clip coupling features 124 that are not present in the currently-available art. The tabs 128 (or alternative features such as roll-overs, bend-downs, and bend-ups, as described below), by being non-planar with the body 123 of portion 121, allow for more stability and less wobbling between the bracket 120 and the lamp socket connection system 101. Specifically, the tabs 128 engage with the coupling features 185 of the spring clip 155 to stabilize the lamp socket connection system 101 relative to the bracket 120. By contrast, in the current art, the lamp socket connection system 101 has little stability, resulting in wobbling of the lamp socket connection system 101.

The shape and size of the aperture 131 of each spring clip coupling feature 124 can be suitable to receive, couple to, and release a coupling feature (e.g., coupling feature 185) of a spring clip. In this case, the aperture 131, when viewed from above, is "T" shaped, and would be rectangular if not for the tabs 128. When there are multiple spring clip coupling features 124, as in this case, the spring clip coupling features 124 can be oriented in one of a number of ways with respect to each other. For example, in this case, the two spring clip coupling features 124 are oriented as mirror images and are equidistantly spaced with respect to the center of the socket receiver coupling feature 125.

Figure 3A:
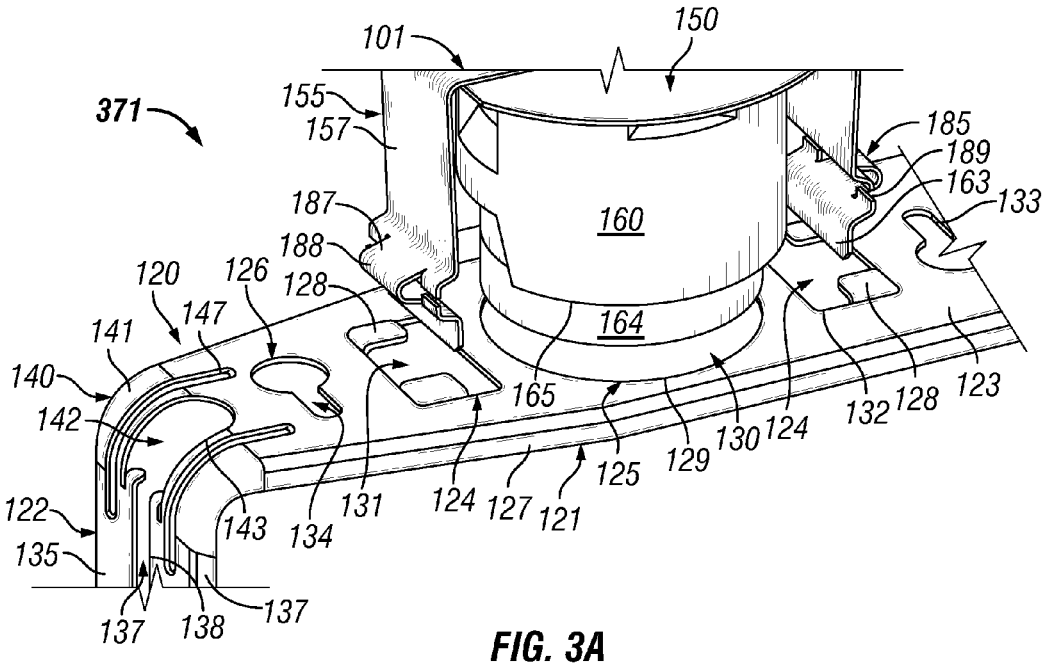
FIGS. 3A-3C show various side views of a bracket assembly in accordance with certain example embodiments.
Figure 3B:
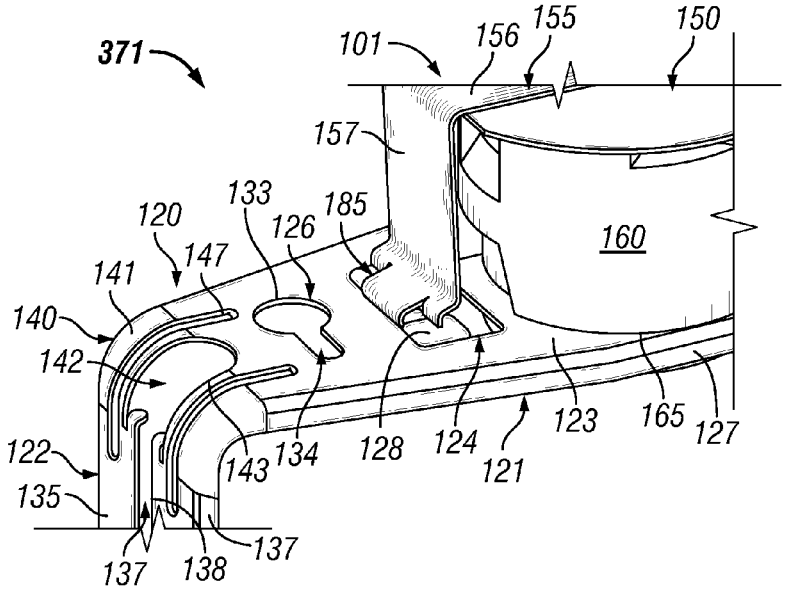
Figure 3C:
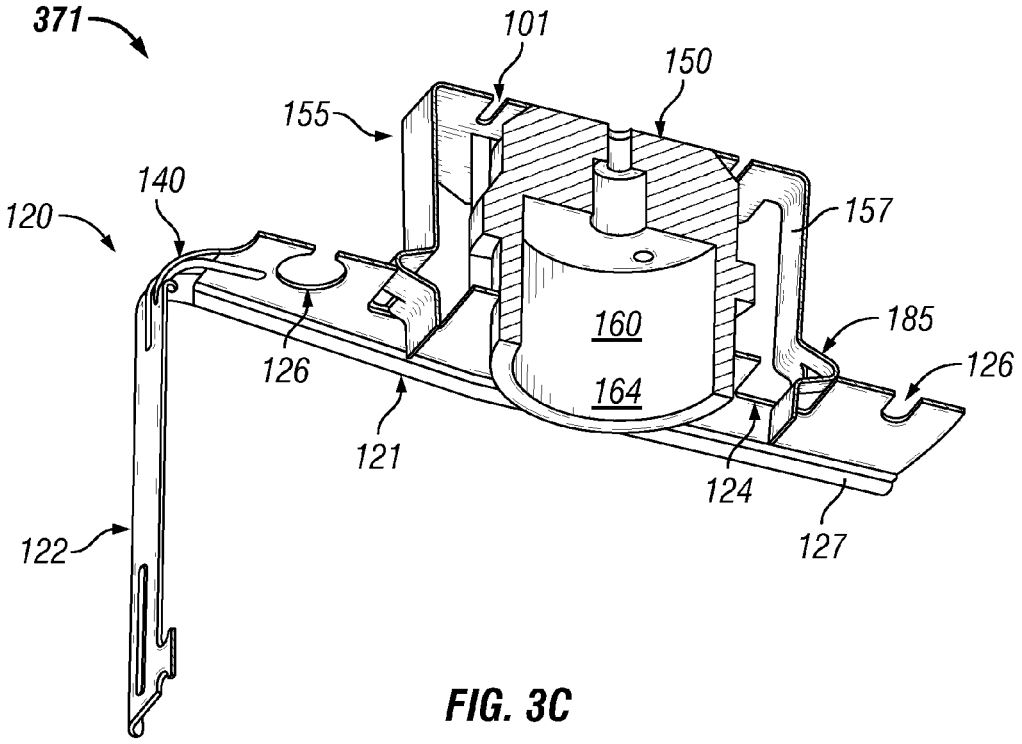
Figure 4:
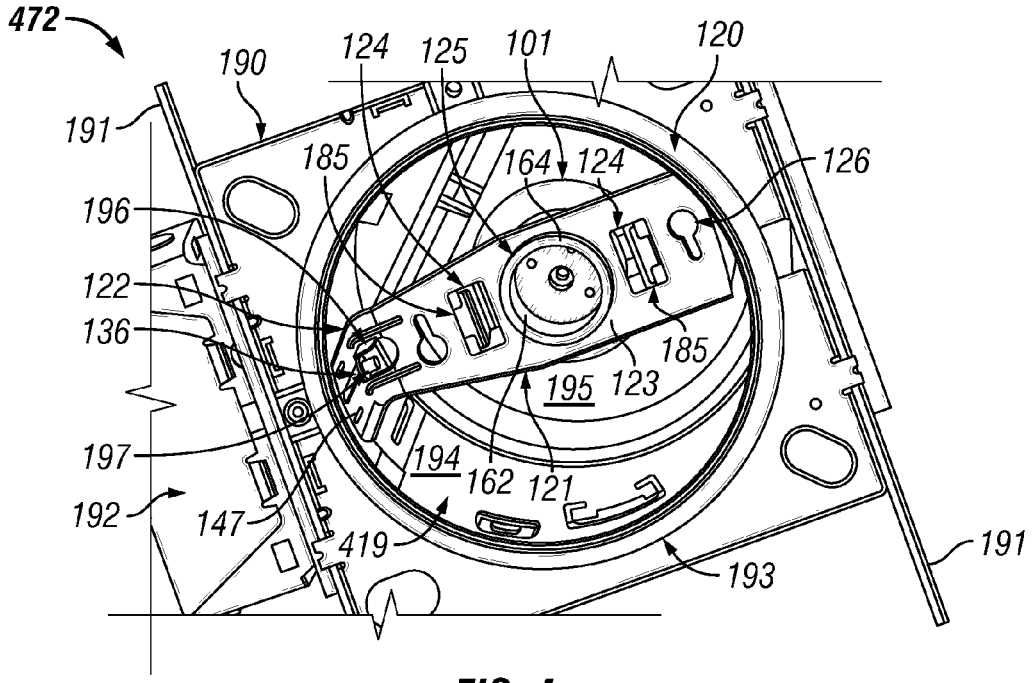
FIG. 4 shows a bottom-side perspective view of a luminaire subassembly in accordance with certain example embodiments.

In certain example embodiments, rather than having separate spring clip coupling features 124 and socket receiver coupling features 125, as with the bracket 120 of FIGS. 2-4, the bracket can have these features combined into one. For example, while the socket receiver coupling feature can remain a circular aperture formed by an outer perimeter that traverses the body at the substantial center of the portion, the two spring clip coupling features can include, in part, rectangular notches defined by an outer perimeter that extend from the outer perimeter of the socket receiver coupling feature. In such a case, the two spring clip coupling features can be substantially symmetrical to each other with respect to the center of the socket receiver coupling feature. In addition, each of the spring clip coupling features can have one or more tabs 128 or alternative example features.

In certain example embodiments, the characteristics (e.g., size, shape, orientation) of the finishing section coupling features 126 are designed complement one or more coupling features of a finishing section (e.g., reflector, baffle, trim, gimble) of a luminaire. In this case, there are two finishing section coupling features 126 shown in FIG. 2, where each finishing section coupling feature 126 is an aperture 134 that traverses the thickness of the body 123 of portion 121. Each aperture 134 in this case has a keyhole shape with a main part that is substantially circular in shape and an extension that substantially linearly extends from the main portion, where the extension has a width that is less than the diameter of the main part.

When there are multiple finishing section coupling features 126, as in this case, the finishing section coupling features 126 can be oriented in one of a number of ways with respect to each other. For example, in this case, the two finishing section coupling features 126 are oriented as mirror images and are equidistantly spaced with respect to the center of the socket receiver coupling feature 125. In certain example embodiments, the various coupling features of portion 121 are oriented as shown in FIG. 2, where the socket receiver coupling feature 125 is surrounded by the spring clip coupling features 124, which are surrounded by the finishing section coupling features 126.

Since portion 121 can support a number of components (e.g., finishing section, light source, lamp socket connection system 101), portion 121 and/or portion 140 can include one or more reinforcement features 127 that help stiffen or otherwise strengthen the bracket 120 so that the bracket 120, or portions thereof, do not become deformed when coupled to other components of the luminaire. For example, the outer sides of body 123 of portion 121 can have reinforcement features 127 in the form of lips. In such a case, the lips 127 can be bent at some angle (e.g., 90°) downward (as shown in FIG. 2) or upward relative to the body 123 of portion 121 and/or the body 141 of portion 140. As another example, as shown in FIG. 2, one or more ribs 147 can protrude from (or be recessed with respect to) the body 123 of portion 123 along some or all of the length of the body 123 and/or the body 141 of portion 140 along some or all of the length of the body 141.

As discussed above, in certain example embodiments, portion 122 of the bracket 120 can also include one or more coupling features. For example, as shown in FIG. 2, portion 122 of the bracket 120 can include one or more housing coupling features 136. In certain example embodiments, the characteristics (e.g., size, shape, orientation) of the housing coupling features 136 are designed complement one or more coupling features of a housing or portion thereof (e.g., housing wall 114) of a luminaire. In this case, there is one housing coupling feature 136 that is a slot 139 (which can also be called an elongated aperture 139) formed by an outer perimeter 138 and that traverses the thickness of the body 135 of portion 122. The shape and size of the slot 139 can be substantially the same as, or slightly larger than, the shape and size of a portion (e.g., a coupling feature) of a housing (or portion thereof) that is disposed within and/or aligned with the slot 139 when the housing is coupled to the housing coupling feature 136.

Since portion 122 is coupled to portion 121 and can support portion 121 and any components (e.g., finishing section, light source, lamp socket connection system 101) coupled thereto, portion 122 can include one or more reinforcement features 127 that help stiffen or otherwise strengthen the bracket 120 so that the bracket 120, or portions thereof, do not become deformed when coupled to other components of the luminaire. For example, the outer sides of body 135 of portion 122 can have reinforcement features 137 in the form of lips. In such a case, the lips 137 can be bent at some angle (e.g., 90°) downward (as shown in FIG. 2) or upward relative to the body 135 of portion 122. As another example, as shown in FIG. 2, one or more ribs 147 can protrude from (or be recessed with respect to) the body 135 of portion 122 along some or all of the length of the body 135.

In certain example embodiments, portion 140 of the bracket 120 can also include one or more coupling features. For example, as shown in FIG. 2, portion 140 of the bracket 120 can include aperture 142, which can be an extension of aperture 139 of coupling feature 136 of portion 122, as shown in FIG. 2, forming a keyhole. The aperture 142 in portion 140 can be physically separated from aperture 139. In addition, aperture 142 can be part of a coupling feature disposed within portion 140. In certain example embodiments, the characteristics (e.g., size, shape, orientation) of the aperture 142 are designed to complement one or more coupling features of another component of a luminaire. In this case, there is one aperture 142 that is a slot (which can also be called an elongated aperture) formed by an outer perimeter 143 and that traverses the thickness of the body 141 of portion 140. As discussed above, in some cases, the aperture 142 can be an extension of a coupling feature of portion 121 and/or portion 122.

FIGS. 3A-3C show various side views of a bracket assembly 371 in accordance with certain example embodiments. The bracket assembly 371 includes the bracket 120 of FIG. 2 and the lamp socket connection system 101 of FIG. 1. FIG. 3A shows a top-side perspective view of the bracket assembly 371 just before the bracket 120 and the lamp socket connection system 101 are coupled to each other. FIG. 3B shows a top-side perspective view of the bracket assembly 371 when the bracket 120 and the lamp socket connection system 101 are coupled to each other. FIG. 3C shows a top-side perspective view of the bracket assembly 371 as the bracket 120 and the lamp socket connection system 101 are being coupled to each other.

Referring to FIGS. 1-3C, the receptacle coupling features 185 of the lamp socket connection system 101 described above with respect to FIG. 1 are now referred to as bracket coupling features 185. Specifically, each bracket coupling feature 185 is disposed within the aperture 131 and couples to a spring clip coupling feature 124. If the lamp socket connection system 101 has another component (e.g., a slidably adjustable bracket) used in place of the spring clip 155, then the characteristics (e.g., shape, size, configuration) of the spring clip coupling features 124 can be configured in such a way to allow that component of the lamp socket connection system 101 to couple to the spring clip coupling features 124. In such a case, the spring clip coupling features 124 can be referred to by any of a number of other suitable names.

In this case, as shown in FIGS. 3A-3C, the tabs 128 of each spring clip coupling feature 124 are configured (e.g., protrude relative to the body 123, have a length and width) in such a way as to abut against the tabs 189 of a bracket coupling feature 185 and also allow the top protrusion 187, the bottom protrusion 186, and/or the apex 188 to be disposed within the aperture 131 between the tabs 128.

In addition, the combination of the wall 164 and the protrusion 165 described above with respect to FIG. 1 can be referred to, individually or collectively, as another bracket coupling feature. In such a case, outer perimeter of the wall 164 can have a substantially similar size as and a slightly smaller shape than the size and shape of the aperture 130 of the socket receiver coupling feature 125. In such a case, the wall 164 (the distal portion of the socket assembly 150) can be disposed within the aperture 130 of the socket receiver coupling feature 125 so that the socket assembly 150 is coupled to the bracket 120. In addition, in some cases, the protrusion 165 of the socket assembly 150 can couple to (e.g., abut against) the top surface of the body 123 of portion 121 when the bracket coupling features 185 are coupled to the spring clip coupling features 124.

FIG. 4 shows a bottom-side perspective view of a luminaire subassembly 472 in accordance with certain example embodiments. The luminaire subassembly 472 of FIG. 4 includes a junction box 192 attached to a frame 190, one or more hangar bars 191 coupled to the frame 190, and a housing 193 coupled to the frame 190. The housing 193 can include a housing body 194 and a housing top 195. The luminaire subassembly 472 can also include the bracket assembly 371 of FIGS. 3A-3C coupled to the housing body 194.

Referring to FIGS. 1-4, the luminaire subassembly 472 is disposed within a cavity 419 formed by the housing body 194 and the housing top 195. The luminaire subassembly 472 is oriented so that the top surface of portion 121 of the bracket 120 is facing the housing top 195. As discussed above, the housing coupling feature 136 of portion 122 of the bracket 120 is configured to couple to a bracket coupling feature 197 disposed in the housing body 194 of the housing 193. In this case, the bracket coupling feature 197 disposed in the housing body 194 is an aperture that indirectly couples to the housing coupling feature 136 of portion 122 of the bracket 120 using a coupling feature 196 (in this case, a screw and a wing nut) that is disposed in both the bracket coupling feature 197 and the housing coupling feature 136. Since the housing coupling feature 136 of the bracket 120 is a slot, the position of the bracket 120 relative to the housing body 194 can be adjusted.

Figure 5:
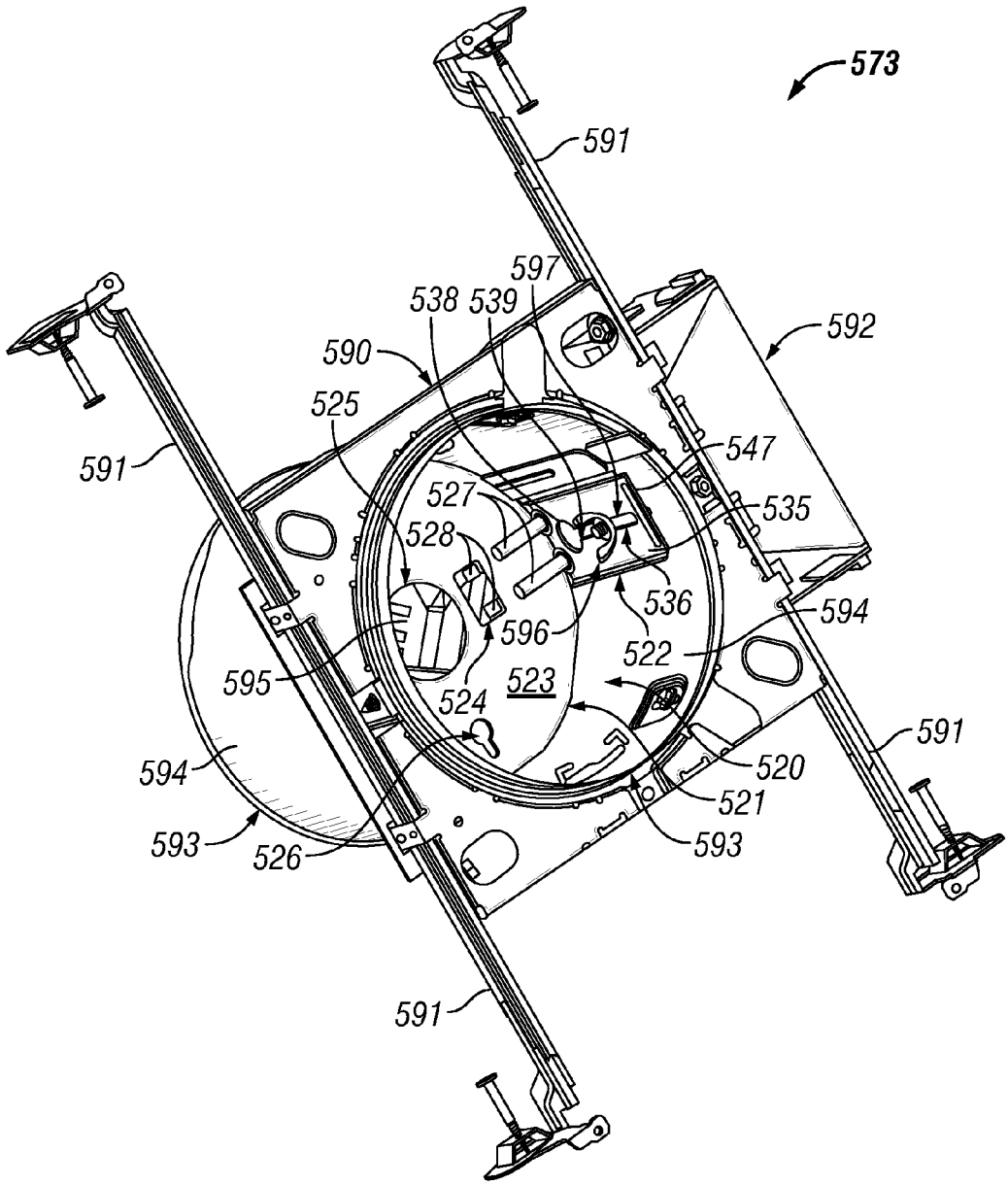
FIG. 5 shows a luminaire assembly that includes another bracket in accordance with certain example embodiments.

FIG. 5 shows a bottom-side perspective view of a luminaire assembly 573 that includes another bracket 520 in accordance with certain example embodiments. The bracket 520 of FIG. 5 is substantially the same as the bracket 120 of FIGS. 2A-4, except as described below. For example, referring to FIGS. 1-5, the body 523 of portion 521 of the bracket 520 is much wider than the body 123 of the bracket 120 of FIGS. 2A-4. In certain example embodiments, the body 523, when viewed from below, can be shaped substantially the same as, and slightly smaller than, the inner perimeter of the housing body 194 and/or the housing top 195 where portion 521 of the bracket 520 is disposed within the cavity 419 of the housing 193. In this way, when portion 521 of the bracket 520 is made of one or more of a number of thermally conductive materials (e.g., aluminum) and/or has a reflective bottom surface, portion 521 of the bracket 520 can be used for shielding, heat sinking, and/or any other function for the luminaire. This configuration of the body 523 of portion 521 of the bracket 520 can be called a blast shield.

In addition, portion 521 of the bracket 520 does not have any lips, as with the lips 127 of the bracket 120 described above. Instead, there are a number of ribs 547 that protrude from the body 523 of portion 521 increase the strength of portion 521. Also, the finishing section coupling features 526, while still having a keyhole shape, are oriented differently with respect to the socket receiver coupling feature 525 when compared with the orientation of the finishing section coupling features 126 relative to the socket receiver coupling feature 125 for the bracket 120 described above.

Further, the housing coupling feature 536 of portion 522 of the bracket 520 of FIG. 5 forms an aperture 539 that traverses the body 535 of portion 522 and has an elongated keyhole shape that does not extend into portion 540. Also, there is only one rib 547 that has a different orientation on the body 535 of portion 522 compared to the ribs 147 disposed on the body 135 of portion 122 of the bracket 120 described above. The bracket 520 of FIG. 5 is coupled to the housing body 594 of the housing 590 in a substantially similar manner as the bracket 120 of FIG. 4 is coupled to the housing body 194 of the housing 190.

Figure 6A:
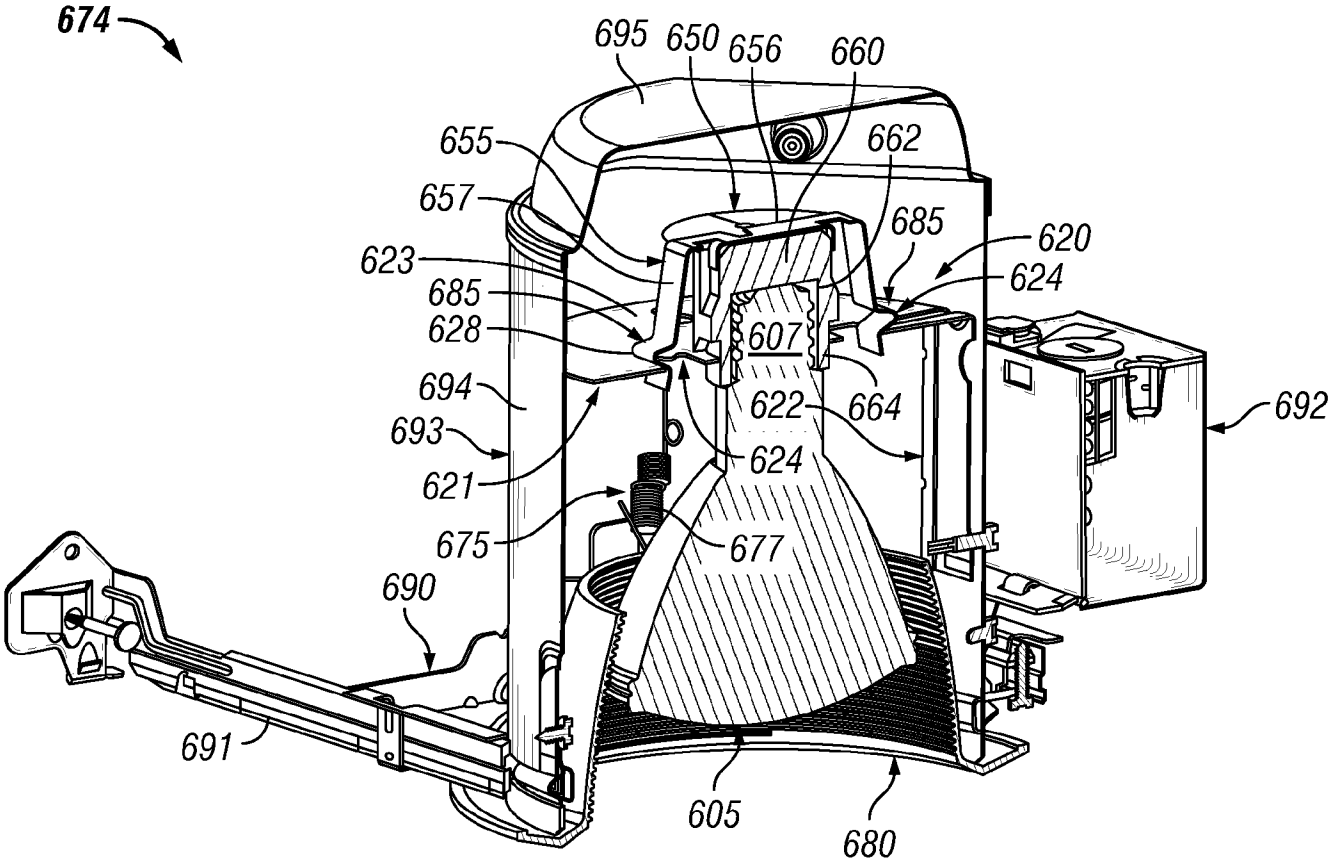
FIGS. 6A and 6B show various views of a luminaire that includes the luminaire assembly of FIG. 5 in accordance with certain example embodiments.
Figure 6B:
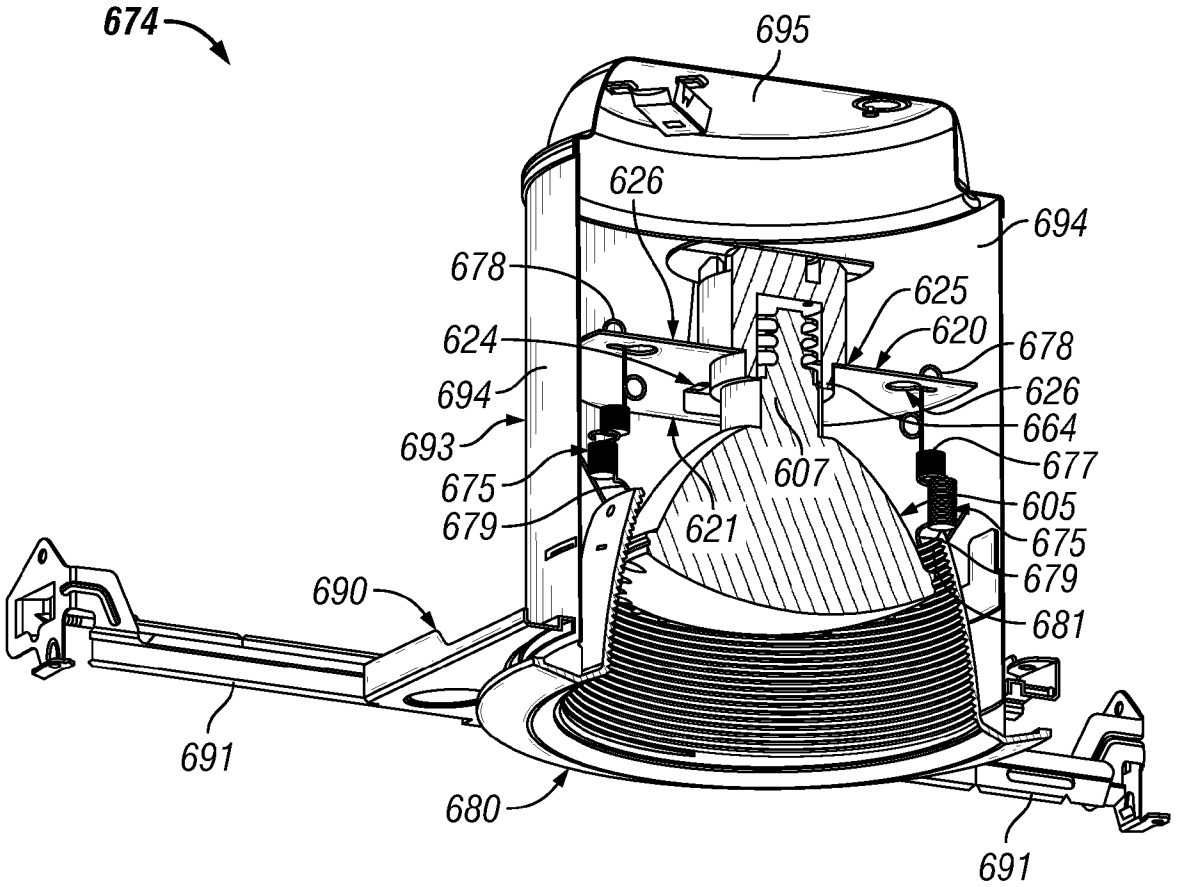

FIGS. 6A and 6B show various views of a luminaire 674 that includes the luminaire assembly 573 of FIG. 5 in accordance with certain example embodiments. Specifically, FIG. 6A shows a cross-sectional top-side view of the luminaire 674, and FIG. 6B shows a cross-sectional bottom-side view of the luminaire 674. Referring to FIGS. 1-6B, in this case, added to the luminaire assembly 573 of FIG. 5 is a finishing section 680 that is coupled to the finishing section coupling features 626 of the bracket 620. The finishing section 680 can be directly or indirectly coupled to the finishing section coupling features 626 of the bracket 620. In this case, the finishing section 680 is indirectly coupled to the finishing section coupling features 626 of the bracket 620 using coupling features 675.

The coupling features 675 can be adjustable and/or otherwise flexible so that the finishing section 680 is suspended in a certain position relative to one or more other components (e.g., the housing 630, the bracket 620, the light source 605) of the luminaire 674. In this case, the coupling features 675 include one or more springs 677 that include a bracket coupling feature 678 at its top end and a finishing section coupling feature 679 at its bottom end. The bracket coupling feature 678 of the coupling feature 675 couples to the finishing section coupling features 626 of the bracket 620, and the finishing section coupling feature 679 of the coupling feature 675 couples to a coupling feature 681 of the finishing section 680.

Contrasting with the reflector assembly 100 of FIG. 1, the luminaire 674 of FIGS. 6A and 6B uses the finishing section 680 rather than a full reflector (e.g., reflector 110). The finishing section 680 is a partial piece that has an open top end through which the light source 605 can be disposed. The finishing section 680, in addition to using less material than a full reflector, adds to ease of installation and manufacturing, increases flexibility in changing or modifying the finishing section 680 (which, in turn, can change the appearance of portions of the luminaire 674 visible to a user), adds to ease of maintenance of the luminaire 674, and reduces costs.

Figure 7:
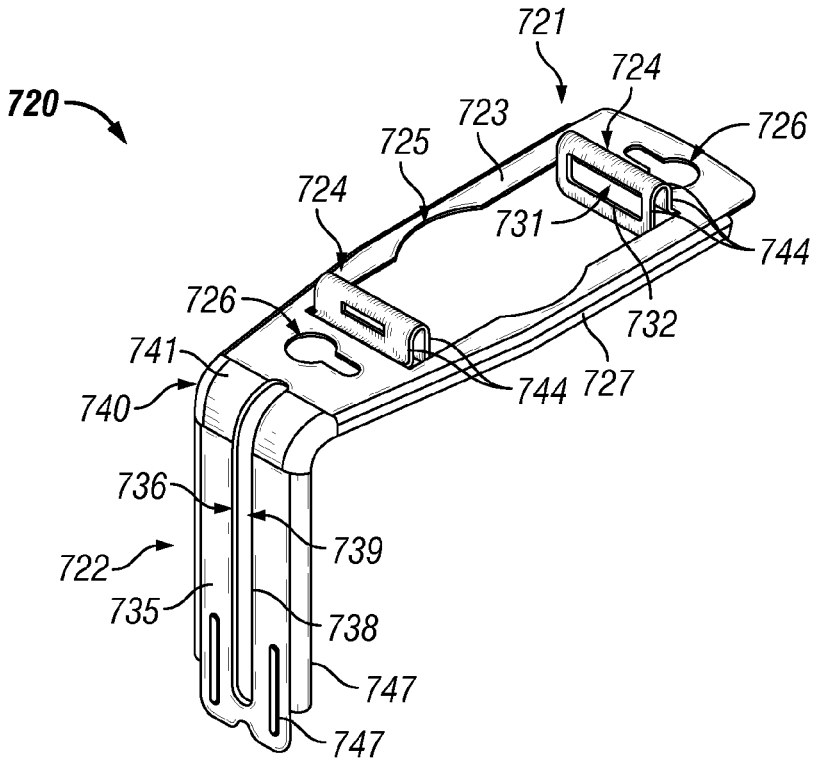
FIG. 7 shows a top-side perspective view of yet another bracket in accordance with certain example embodiments.

FIG. 7 shows a top-side perspective view of yet another bracket 720 in accordance with certain example embodiments. The bracket 720 of FIG. 7 is substantially similar to the bracket 120 of FIGS. 2A-4, except as described below. Referring to FIGS. 1-7, the socket receiver coupling feature 725 and the spring clip coupling features 724 of the bracket 720 are combined into one, as with the bracket 520 of FIGS. 5-6B. In this case, the spring clip coupling features 724 include larger rectangular tabs 744 punched through the body 723 of portion 721 and rolled onto themselves and away from the socket receiver coupling feature 725.

The rectangular tabs 744 of the spring clip coupling features 724 can be bent downward (as shown in FIG. 7) (a bent-down configuration) and/or upward (a bent-up configuration). In this case, the rectangular tabs 744 are used in place of the tabs 128 shown in FIGS. 2-4 above. In other words, the receptacle coupling feature (e.g., receptacle coupling feature 185) (or equivalent thereof) of a spring clip (e.g., spring clip 155) couples to (e.g., is disposed within) the aperture 731 of the spring clip coupling feature 724. In such a case, if the receptacle coupling feature is configured similar to the receptacle coupling feature 185 of FIG. 1 above, then the top protrusion 187, the bottom protrusion 186, and the apex 188 of the receptacle coupling feature 185 are disposed within the aperture 731 and couple the spring clip 155 to the bracket 720. While described herein and shown in FIG. 7 as rectangular, the tabs 744 can have any of a number of other shapes, including but not limited to square, triangular, polygonal, and triangular.

Figure 8:
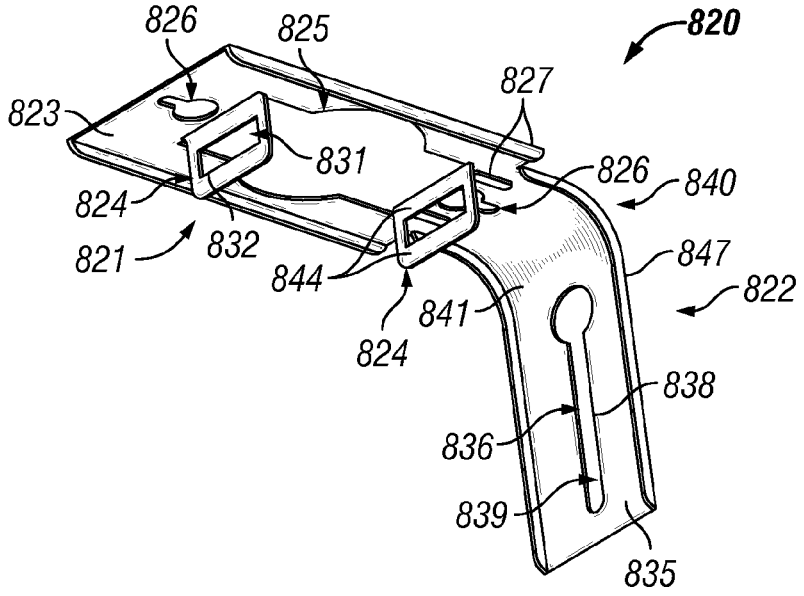
FIG. 8 shows a top-side perspective view of still another bracket in accordance with certain example embodiments.

FIG. 8 shows a top-side perspective view of still another bracket 820 in accordance with certain example embodiments. The bracket 820 of FIG. 8 is substantially similar to the various brackets of FIGS. 2A-7, except as described below. Referring to FIGS. 1-8, the socket receiver coupling feature 825 and the spring clip coupling features 824 of the bracket 820 are combined into one. In this case, the spring clip coupling features 824 include larger rectangular tabs 844 punched through the body 823 of portion 821 (as with the bracket 720 of FIG. 7 above). In this case, however, the rectangular tabs 844 of the spring clip coupling features 824 are bent downward and away from the socket receiver coupling feature 825. In other words, the receptacle coupling feature (e.g., receptacle coupling feature 185) (or equivalent thereof) of a spring clip (e.g., spring clip 155) couples to (e.g., is disposed within) the aperture 831 of the spring clip coupling feature 824.

In such a case, if the receptacle coupling feature is configured similar to the receptacle coupling feature 185 of FIG. 1 above, then the top protrusion 187, the bottom protrusion 186, and the apex 188 of the receptacle coupling feature 185 are disposed within the aperture 831 and couple the spring clip 155 to the bracket 820. The rectangular tabs 844 of the spring clip coupling features 824 can be bent upward and/or in any other direction, and the rectangular tabs 844 can have any of a number of shapes besides rectangular.

Figure 9:
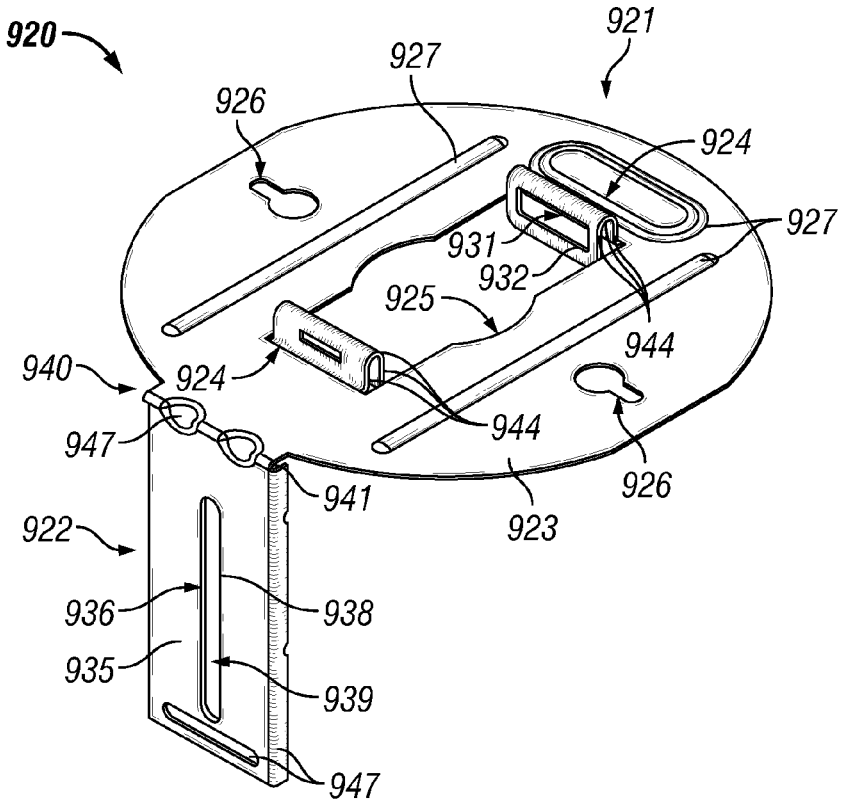
FIG. 9 shows a top-side perspective view of yet another bracket in accordance with certain example embodiments.

FIG. 9 shows a top-side perspective view of yet another bracket 920 in accordance with certain example embodiments. Referring to FIGS. 1-9, in this case, the bracket 920 of FIG. 9 has a size and shape of the body 923 of portion 921 substantially similar to the size and shape of the body 523 of the bracket 520 of FIG. 5. Also, the characteristics (e.g., size, shape, configuration, tabs 944) of the spring clip coupling features 924 and the socket receiver coupling feature 925 are substantially similar to corresponding characteristics of the spring clip coupling features 724 and the socket receiver coupling feature 725 of the bracket 720 of FIG. 7 above. Consequently, the receptacle coupling feature (e.g., receptacle coupling feature 185) (or equivalent thereof) of a spring clip (e.g., spring clip 155) couples to (e.g., is disposed within) the aperture 731 of the spring clip coupling feature 724.

Figure 10:
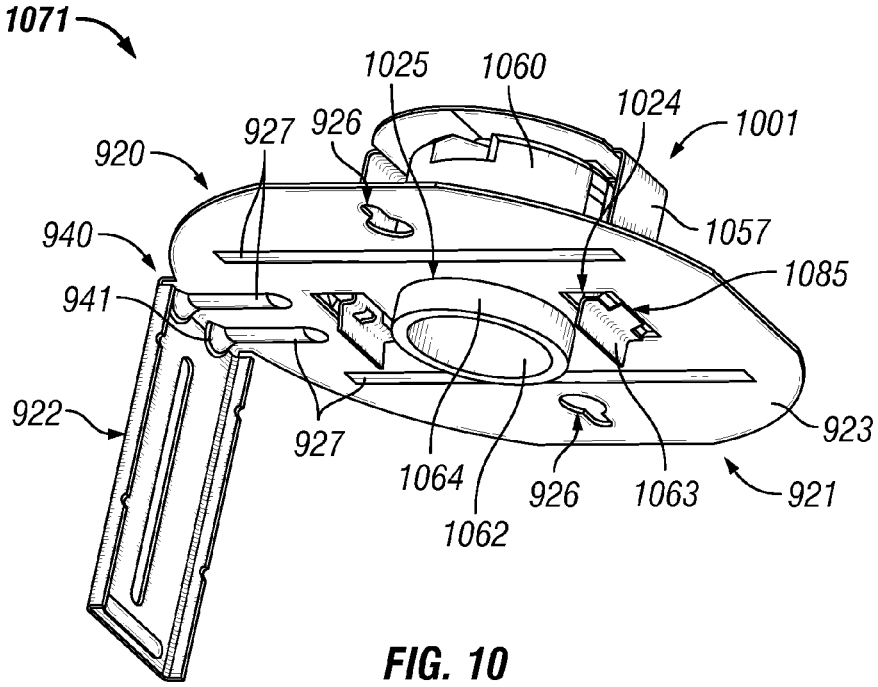
FIG. 10 shows a bottom-side perspective view of another bracket assembly in accordance with certain example embodiments.

FIG. 10 shows a bottom-side perspective view of another bracket assembly 1071 in accordance with certain example embodiments. The bracket assembly 1071 includes the bracket 920 of FIG. 9 coupled to the lamp socket connection system 101 of FIGS. 1-4. As discussed above, the body 923 of portion 921 of the bracket 920, when viewed from below, can be shaped substantially the same as, and slightly smaller than, the inner perimeter of the housing body and/or the housing top where portion 921 of the bracket 920 is disposed within the cavity of the housing. In this way, when portion 921 of the bracket 920 is made of one or more of a number of thermally conductive materials (e.g., aluminum) and/or has a reflective bottom surface, portion 921 of the bracket 920 can be used for shielding, heat sinking, and/or any other function for the luminaire.

Certain example embodiments provide a number of benefits. Examples of such benefits include, but are not limited to, use of fewer materials, simplified installation, simplified inspection, simplified maintenance, installation of a luminaire in relatively small spaces, and reduced cost. Example brackets described herein also allow for increased flexibility for manufacturing, installing, and/or maintaining a luminaire. In addition, example brackets allow for ease of installation while providing an air-tight condition for the luminaire. Example embodiments can also be used to assist with thermal management and/or shielding for the luminaire.

Although embodiments described herein are made with reference to example embodiments, it should be appreciated by those skilled in the art that various modifications are well within the scope and spirit of this disclosure. Those skilled in the art will appreciate that the example embodiments described herein are not limited to any specifically discussed application and that the embodiments described herein are illustrative and not restrictive. From the description of the example embodiments, equivalents of the elements shown therein will suggest themselves to those skilled in the art, and ways of constructing other embodiments using the present disclosure will suggest themselves to practitioners of the art. Therefore, the scope of the example embodiments is not limited herein.

What is claimed is:

1. A bracket assembly for a luminaire, the bracket assembly comprising:

a first portion comprising a socket receiver coupling feature and at least one spring clip coupling feature disposed within a first body of the first portion, wherein the at least one spring clip coupling feature comprises a first engagement portion and at least one second engagement portion located adjacent to the first engagement portion, wherein the first engagement portion is planar with the first body, and wherein the at least one second engagement portion is non-planar with the first body; and a second portion coupled to a proximal end of the body of the first portion, wherein the second portion comprises at least one first housing coupling feature disposed within a second body of the second portion, wherein the socket receiver coupling feature is configured to receive a socket of the luminaire, a spring clip, wherein the first engagement portion of the at least one spring clip coupling feature comprises an aperture formed, at least in part, by the at least one second engagement portion, wherein the aperture of the first engagement portion receives a first portion of the spring clip, wherein the first portion of the spring clip forms an outward protrusion relative to a body of the spring clip, wherein the outward protrusion includes an angled upper portion, a symmetrically angled lower portion, and an apex disposed therebetween, wherein the at least one second engagement portion of the at least one spring clip coupling feature abuts against at least one second portion of the spring clip, and wherein the at least one first housing coupling feature is configured to couple to at least one second bracket coupling feature of a housing of the luminaire.

2. The bracket of claim 1, wherein the at least one second engagement portion of the spring clip coupling feature comprises a first tab and a second tab.

3. The bracket of claim 1, wherein the socket receiver coupling feature comprises an aperture that traverses the first body, wherein the aperture is configured to receive a socket of the luminaire.

4. The bracket of claim 1, wherein the second portion further comprises at least one second housing coupling feature that is configured to couple to at least one fourth bracket coupling feature of a housing of the luminaire.

5. The bracket of claim 1, wherein the first engagement portion of the at least one spring clip coupling feature comprises a pair of symmetrically oriented apertures, wherein the apertures are symmetrical with respect to a center of the socket receiver coupling feature.

6. The bracket of claim 1, wherein the at least one second engagement portion of the at least one spring clip coupling feature is substantially parallel to the first body of the first portion.

7. The bracket of claim 1, wherein the first engagement portion of each of the at least one spring clip coupling features comprises a T-shaped window that traverses the first body.

8. The bracket of claim 7, wherein each T-shaped window is formed, in part, by creating a T-shaped aperture that traverses a section of the first body and bending the at least one second engagement portion of the spring clip coupling feature, forming part of the T-shaped aperture, relative to the first body.

9. The bracket of claim 8, wherein each T-shaped window is formed by creating an aperture that traverses a section of the first body and rolling the section relative to the first body.

10. The bracket of claim 1, wherein the first portion is disposed substantially perpendicular to the second portion so that the first portion and the second portion form a "L" shape when positioned in a side view.

11. The bracket of claim 1, wherein the first body has a shape and a size that is substantially similar to the shape and the size formed by an inner surface of the housing of the luminaire in which the first body is configured to be disposed.

12. The bracket of claim 11, wherein the first body comprises a thermally conductive material.

13. The bracket of claim 1, wherein the first portion further comprises at least one finishing section coupling feature, wherein the at least one finishing section coupling feature is configured to couple to a finishing section of the luminaire.

14. The bracket of claim 1, wherein the first portion further comprises at least one reinforcement feature disposed on the first body, wherein the at least one reinforcement feature prevents the first body from becoming deformed.

15. The bracket of claim 1, wherein the first portion and the second portion are non-planar and non-perpendicular relative to each other.

16. A luminaire, comprising:

a housing comprising a housing body with at least one housing wall having an inner perimeter that forms a cavity, wherein the at least one housing wall comprises at least one first bracket coupling feature;

a spring clip disposed within the cavity, wherein the spring clip comprises at least one first bracket coupling portion and at least one second bracket coupling portion disposed adjacent to the at least one first bracket coupling portion, wherein the first bracket coupling portion forms an outward protrusion relative to a body of the spring clip, wherein the outward protrusion includes an angled upper portion, a symmetrically angled lower portion, and an apex disposed therebetween; and a bracket disposed within the cavity and coupled to the at least one housing wall and the spring clip, wherein the bracket comprises:

a first portion comprising at least one spring clip coupling feature disposed within a first body of the first portion, wherein the at least one spring clip coupling feature comprises a first engagement portion and at least one second engagement portion located adjacent to the first engagement portion, wherein the first engagement portion is planar with the first body, and wherein the at least one second engagement portion is non-planar with the first body; and a second portion coupled to a proximal end of the body of the first portion, wherein the second portion comprises at least one first housing coupling feature disposed within a second body of the second portion, wherein the at least one first housing coupling feature is coupled to the at least one first bracket coupling feature, wherein the first engagement portion of the at least one spring clip coupling feature comprises an aperture formed, at least in part, by the at least one second engagement portion, wherein the aperture of the first engagement portion receives the at least one first bracket coupling portion of the spring clip, and wherein the at least one second engagement portion of the at least one spring clip coupling feature abuts against the at least one second bracket coupling portion of the spring clip.

17. The luminaire of claim 16, wherein the second portion of the bracket is substantially parallel to the at least one housing wall, and wherein the first portion of the bracket is substantially parallel to a top of the housing.

18. The luminaire of claim 16, wherein the first body of the first portion has a shape that is substantially similar to that of the cavity proximate to where the first body is disposed, and wherein the first body has a size that is substantially the same as that of the cavity proximate to where the first body is disposed.

19. The luminaire of claim 16, further comprising:

a socket assembly disposed within the housing and coupled to the spring clip, wherein the socket assembly comprises a socket receiver body and a wall, wherein the socket receiver body that abuts against a top surface of the first body of the first portion of the bracket, and wherein the wall traverses a socket receiver coupling feature of the first portion of the bracket.

20. The luminaire of claim 16, further comprising:

a finishing section coupled to the bracket, wherein the finishing section comprises at least one third bracket coupling feature that is coupled to at least one finishing section coupling feature of the first portion of the bracket.

* * * * *